US008011276B2

(12) United States Patent
Varme

(10) Patent No.: US 8,011,276 B2
(45) Date of Patent: Sep. 6, 2011

(54) WINCH-TYPE CORKSCREW ASSEMBLY

(76) Inventor: Byron Kahrs Varme, Houston, TX (US)

( * ) Notice: Subject to any disclaimer, the term of this patent is extended or adjusted under 35 U.S.C. 154(b) by 261 days.

(21) Appl. No.: 12/288,421

(22) Filed: Oct. 20, 2008

(65) Prior Publication Data

US 2010/0095808 A1 Apr. 22, 2010

(51) Int. Cl.
*B67B 7/04* (2006.01)

(52) U.S. Cl. ..... 81/3.45; 81/3.36; 81/3.33

(58) Field of Classification Search ..... 81/3.29–3.37, 81/3.39, 3.45
See application file for complete search history.

(56) References Cited

U.S. PATENT DOCUMENTS 197,201 A * 11/1877 Baum ..... 81/3.33
264,902 A * 9/1882 Slagle ..... 81/3.33
276,804 A * 5/1883 Green ..... 81/3.29
303,400 A * 8/1884 Redlich ..... 81/3.33
348,743 A * 9/1886 Hurley ..... 81/3.33
348,911 A * 9/1886 Hurley ..... 81/3.33
406,304 A * 7/1889 Pollard et al. ..... 81/3.33
495,386 A * 4/1893 Weisz ..... 81/3.33
695,235 A * 3/1902 Riolet ..... 81/3.37
778,112 A * 12/1904 Church ..... 30/433
2,004,211 A * 6/1935 Munzinger ..... 81/3.2
4,135,415 A * 1/1979 Liebscher et al. ..... 81/3.29
2005/0217434 A1* 10/2005 Opolka ..... 81/3.37

* cited by examiner

*Primary Examiner* — Debra S Meislin

(57) ABSTRACT

An auger-type corkscrew is housed in a body with an opening for communicating with the cork in a wine bottle or the like. An auger tip is carried in the body and is adapted to be rotated and extended into and rotated and withdrawn out of contact with the cork. The drive mechanism is mounted in the body for rotating and extending and withdrawing the auger tip. A winch-type handle is mounted outside the body and in driving communication with the drive mechanism, whereby rotation of the winch-type handle activates the drive mechanism for rotating and extending and withdrawing the auger tip.

4 Claims, 5 Drawing Sheets

WINCH-TYPE CORKSCREW ASSEMBLY

BACKGROUND OF THE INVENTION

1. Field of the Invention

This invention is generally related to corkscrews for removing corks from wine bottles and the like and is specifically directed to a corkscrew assembly having a mechanized rotary motion for an auger type corkscrew.

2. Discussion of Prior Art

Corkscrews for removing the cork from a wine bottle and the like have been available for at least two centuries. S. Henshall patented an auger-type corkscrew in 1895 and the basic concept has not changed since that time. Numerous improvements have been made over the years.

Herbert Allen has received a patent for an improvement in the basic auger type screw and pull corkscrew as disclosed in U.S. Pat. No. 4,291,597 issued on Sep. 29, 1981. Mr. Allen has also received a patent on a lever-action corkscrew, U.S. Pat. No. 4,253,351 issued on Mar. 31, 1981.

Mr. Allen has also received numerous patents on variations of these designs, wherein the auger type screw is encapsulated in an outer sheath or cover which is adapted to fit over the mouth opening of the wine bottle, see U.S. Pat. No. 4,276,789 issued on Jul. 7, 1981; U.S. Pat. No. 4,377,096 issued on Mar. 22, 1983; U.S. Pat. No. 4,429,444 issued on Feb. 7, 1984; DES 293,414 issued on Dec. 29, 1987; U.S. Pat. No. 4,800,784 issued on Jan. 31, 1989; and U.S. Pat. No. 4,703,673 issued on Nov. 3, 1987.

In addition, Mr. Allen has two patents on a cork puller which does not rely on penetrating the cork but instead relies on twisting torque and a pulling action, see U.S. Pat. No. 4,800,783 issued on Jan. 31, 1989 and U.S. Pat. No. 5,042,331 issued on Aug. 27, 1991.

With the exception of the lever action design disclosed in U.S. Pat. No. 4,253,351 and the torque twist and pull designs shown in U.S. Pat. Nos. 4,800,783 and 5,042,331 all of the Allen corkscrews rely on an auger type tip for penetrating the cork and a twisting action wherein the twisting force is applied while gripping the corkscrew in a manner which is in axial alignment with the auger tip.

SUMMARY OF THE INVENTION

The subject invention not only provides a decorative corkscrew but also takes advantage of providing a rotary or twisting action outward of the auger axis, providing additional leverage for making it easier to twist the cork by applying a lower force. This is particularly advantageous when a person with small hands or limited strength is attempting to remove the cork from a bottle.

In the preferred embodiment the corkscrew is housed in an attractive housing designed in appearance to resemble a nautical winch mounting block. The rotating actuator handle is in the shape of a winch handle. The corkscrew mechanism is in communication with the actuator handle and is housed in the mounting block housing. The winch handle may be oriented for turning about either a vertical or a horizontal axis.

The winch handle configuration provides additional torque when turning the corkscrew, facilitating the removal of the cork from a bottle. In addition, the winch handle design and decorative mounting block provide a decorative accent piece with the corkscrew being hidden from view when not in use.

In the preferred embodiment the corkscrew assembly includes a body having an opening for communicating with the cork in the bottle. An auger tip is carried in the body and is adapted to be rotated and extended into and rotated and withdrawn out of contact with the cork. The drive mechanism is mounted in the body for rotating and extending and withdrawing the auger tip. A winch-type handle is mounted outside the body and in driving communication with the drive mechanism, whereby rotation of the winch handle activates the drive mechanism for rotating and extending and withdrawing the auger tip. The winch-type handle may be mounted either for rotation about a vertical axis or about a horizontal axis. When mounted for horizontal rotation a differential gear assembly is mounted in the body and in communication with both the drive mechanism and the winch-type handle for translating the horizontal rotation of the winch handle to a vertical rotation in communication with the drive mechanism.

DETAILED DESCRIPTION OF THE PREFERRED EMBODIMENTS

Figure 1:
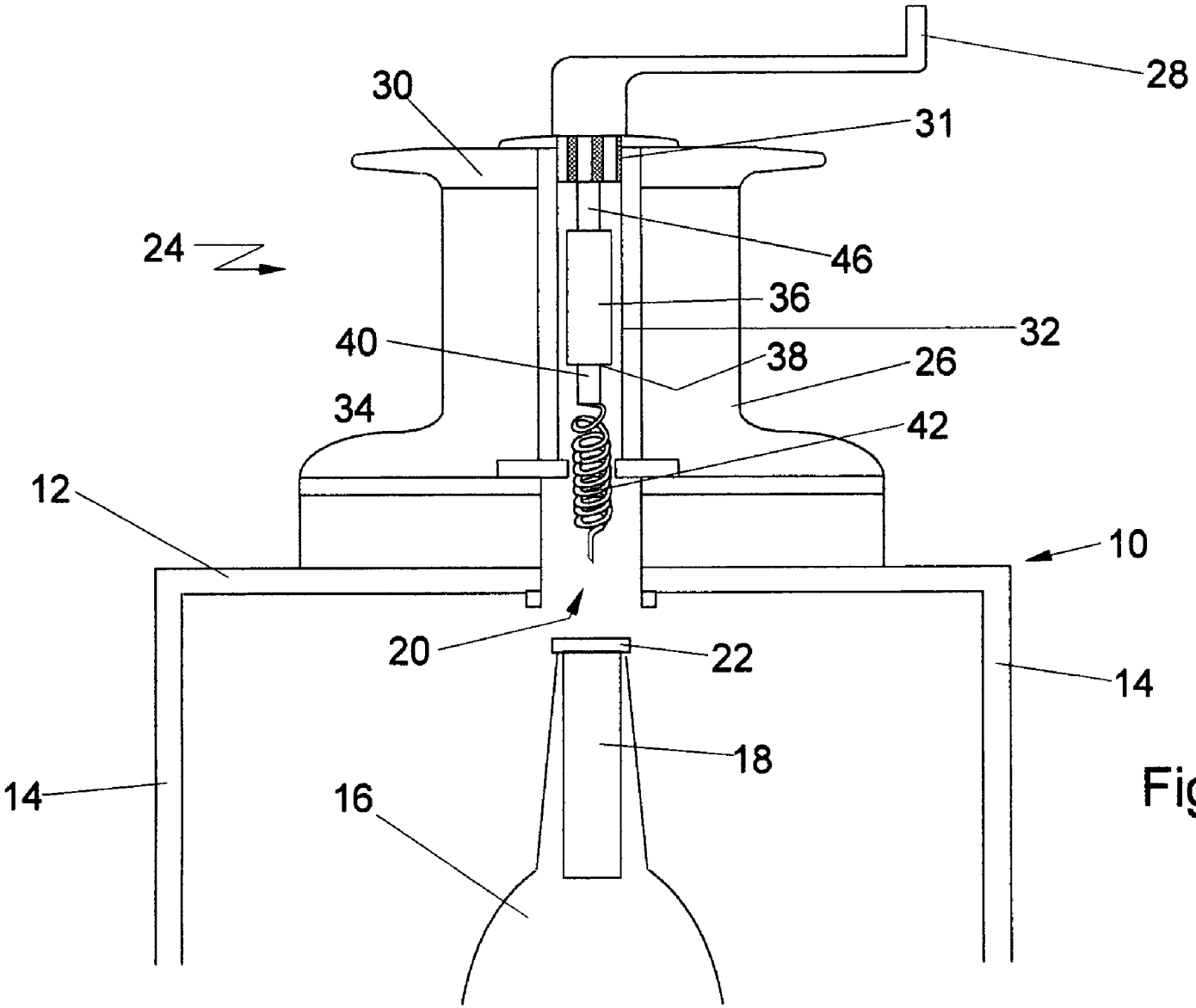
FIG. 1 is a sectional view of a winch-type corkscrew assembly in accordance with the invention and having a winch handle adapted for rotation about the axis of the auger type corkscrew tip.

With specific reference to FIG. 1, the winch-type corkscrew assembly of the subject invention includes a mounting box 10 having a top 12 and side walls 14 and a generally open bottom for receiving a typical wine bottle 16 having a closure cork 18. The top wall 12 of the box includes an opening 20 which permits the corked top 22 of the bottle to be placed in position under the corkscrew mechanism 24.

The corkscrew mechanism 24 includes an outer housing 26, which in the preferred embodiment is shaped to represent a nautical winch body for decorative appeal. However, the shape of the body is not a limiting feature of the invention. A winch handle 28 is mounted for rotation on the top 30 of the winch body. A typical bearing assembly 31 provides for smooth rotation of the handle in the housing.

The winch body has a central bore 32 for accommodating the auger tip mechanism 34. In the preferred embodiment, the central bore is internally threaded. A plunger 36 has complementary external threads and is received in the central bore 32. A mounting post 40 extends from the lower end 38 of the plunger. The auger-type tip 42 is secured to and extends axially from the post 40.

Figures 2, 3:
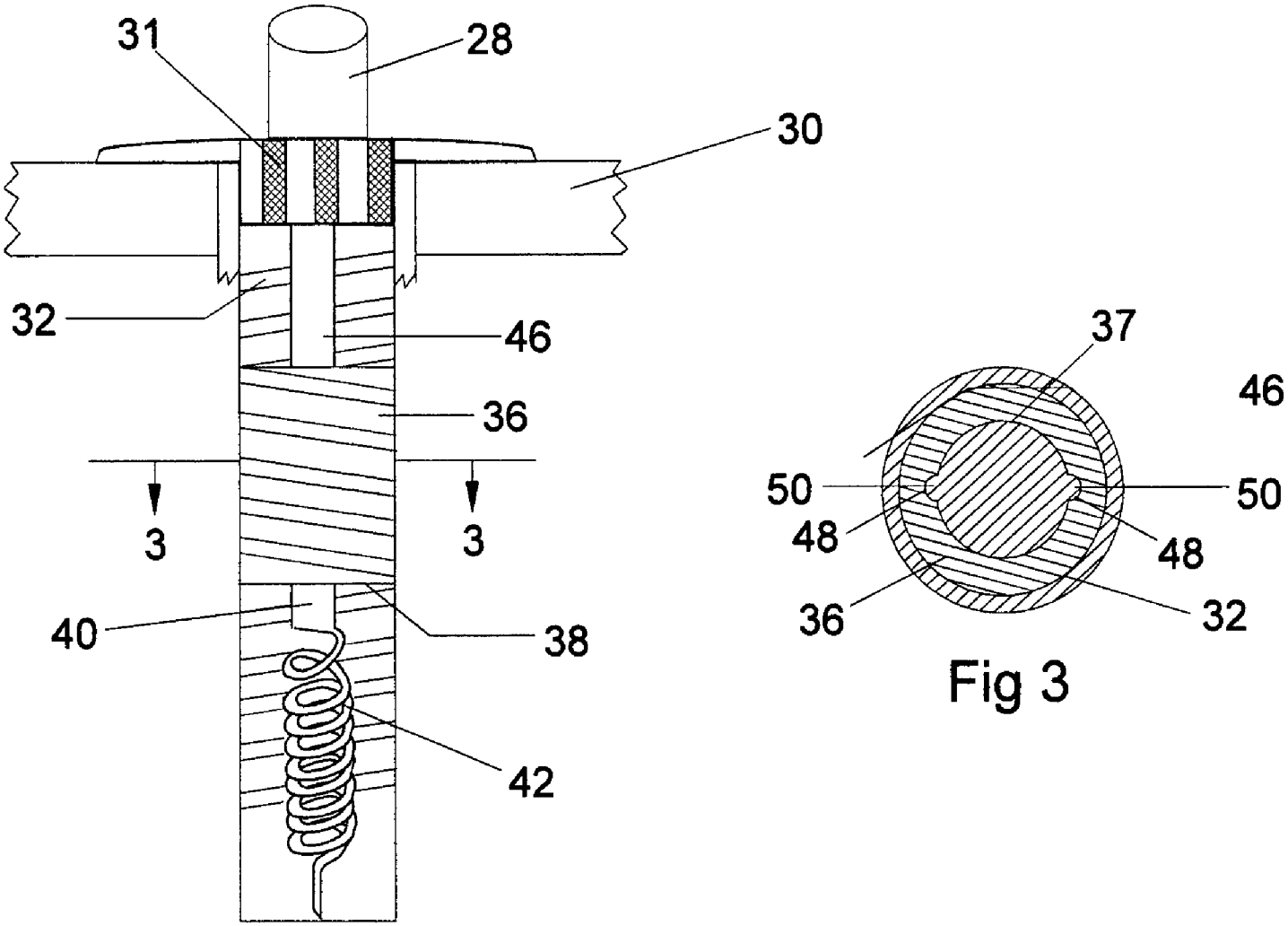
FIG. 2 is an enlarged partial view looking in the same direction as FIG. 1.
FIG. 3 is a sectional view taken along line 3-3 of FIG. 2

As better shown in FIGS. 2 and 3, the working mechanism includes the plunger assembly 36, winch handle 28 and bore 32 assembled in such a manner that rotation of the winch handle 28 about the bore axis will cause the plunger 36 to rotate and move axially by traveling along the internal threads of the bore, causing the auger tip to rotate and penetrate the cork 22 of the bottle. As best shown in FIG. 3, the plunger 36 includes an open central bore 37 for receiving the drive pin 46 of the winch handle assembly. The drive pin 46 is mounted for rotation with the winch handle. The plunger bore 37 includes one or more channels 48 extending along its length. The drive pin 46 includes mated ribs 50 which fit into the channels 48. The plunger is slidably mounted on the pin 46 and is axially movable along the pin as the plunger and pin are rotated by the winch handle.

Figure 4:
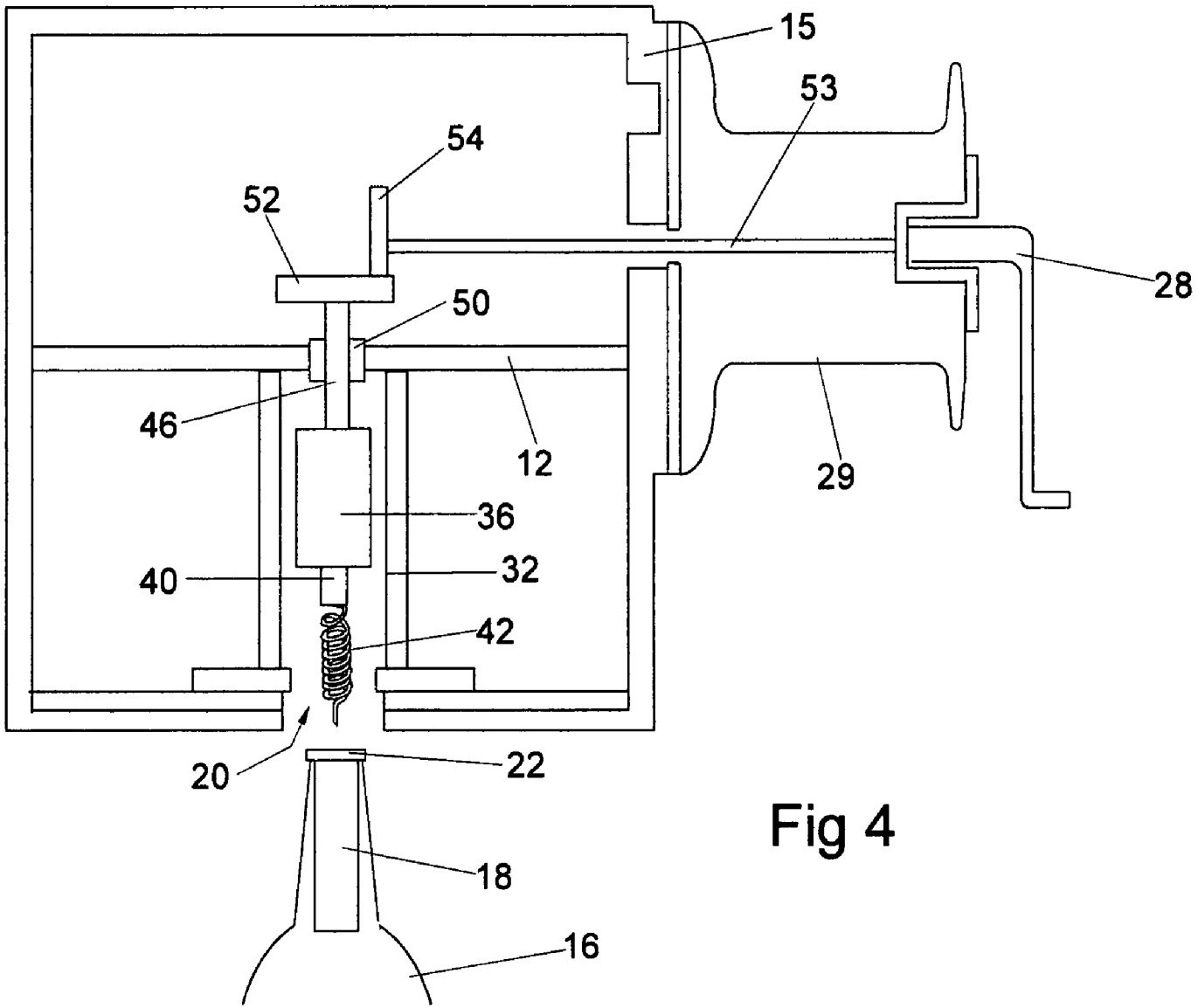
FIG. 4 is an alternative embodiment of the winch-type corkscrew assembly with a horizontally extending winch handle.
Figure 5:
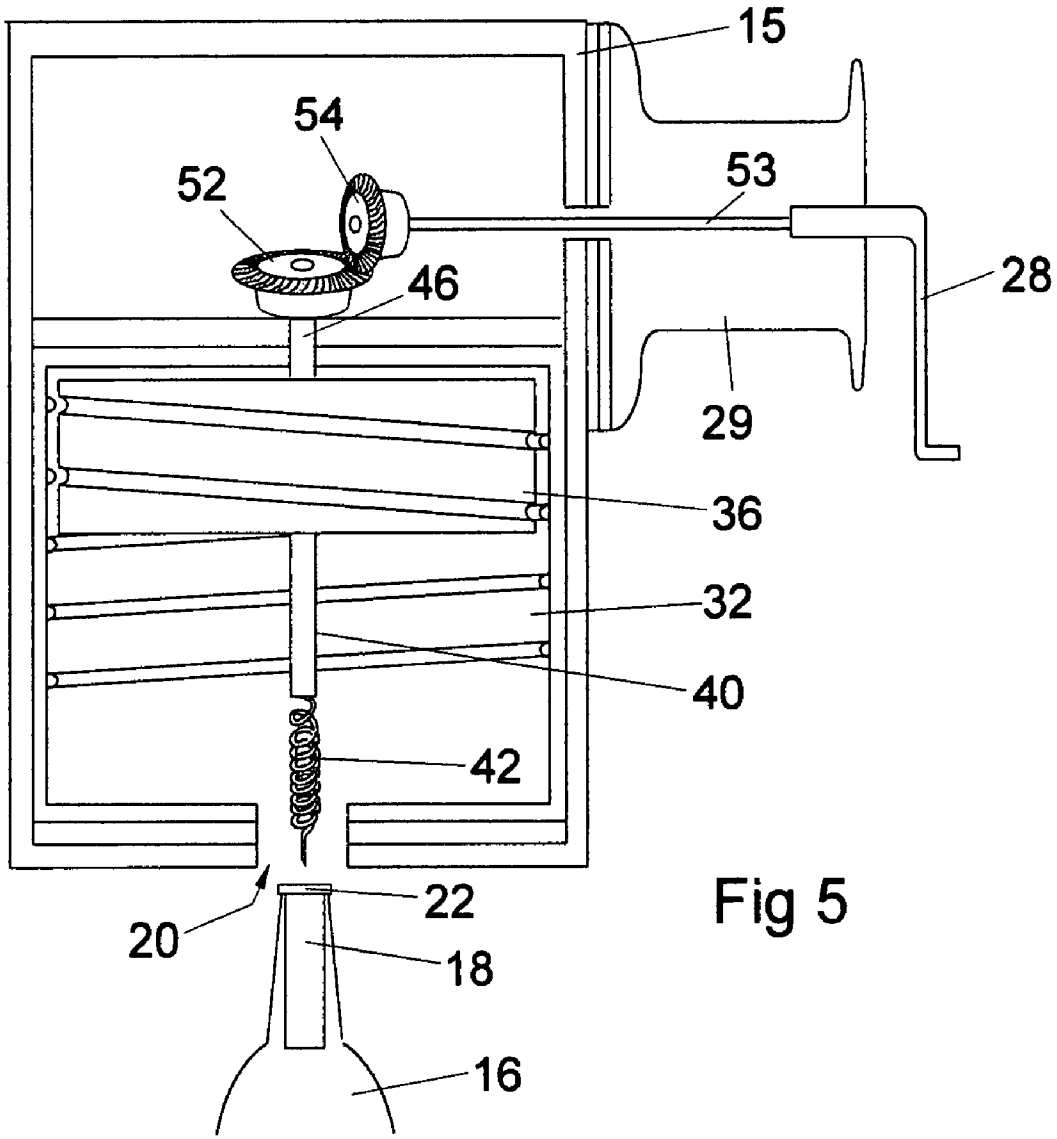
FIG. 5 is a view similar to FIG. 4, showing the differential gear.

An alternative embodiment with a horizontally extending winch handle is shown in FIGS. 4 and 5. All of the components below the plate 12, which corresponds to the top 12 of FIGS. 1-3, are identical to the assembly shown in FIGS. 1-3 and are like numbered. In this embodiment the drive pin 46 is mounted for rotation in a bearing block 50. A horizontal differential gear 52 is mounted for axial rotation at the top of pin 46.

The winch handle 28 and winch body 29 are mounted on an extended sidewall 15 of the box. A drive shaft 53 is attached for rotation with the winch handle 28 and extends through the box sidewall 15. The drive shaft 53 terminates in a differential gear 54 which is mounted for horizontal rotation and is mated with the gear 52 for translating the horizontally rotating action of the winch handle to the vertical drive pin 46. The working mechanism is more clearly shown in FIG. 5. Like numbers correspond to the same components in FIGS. 1-4.

Figure 6:
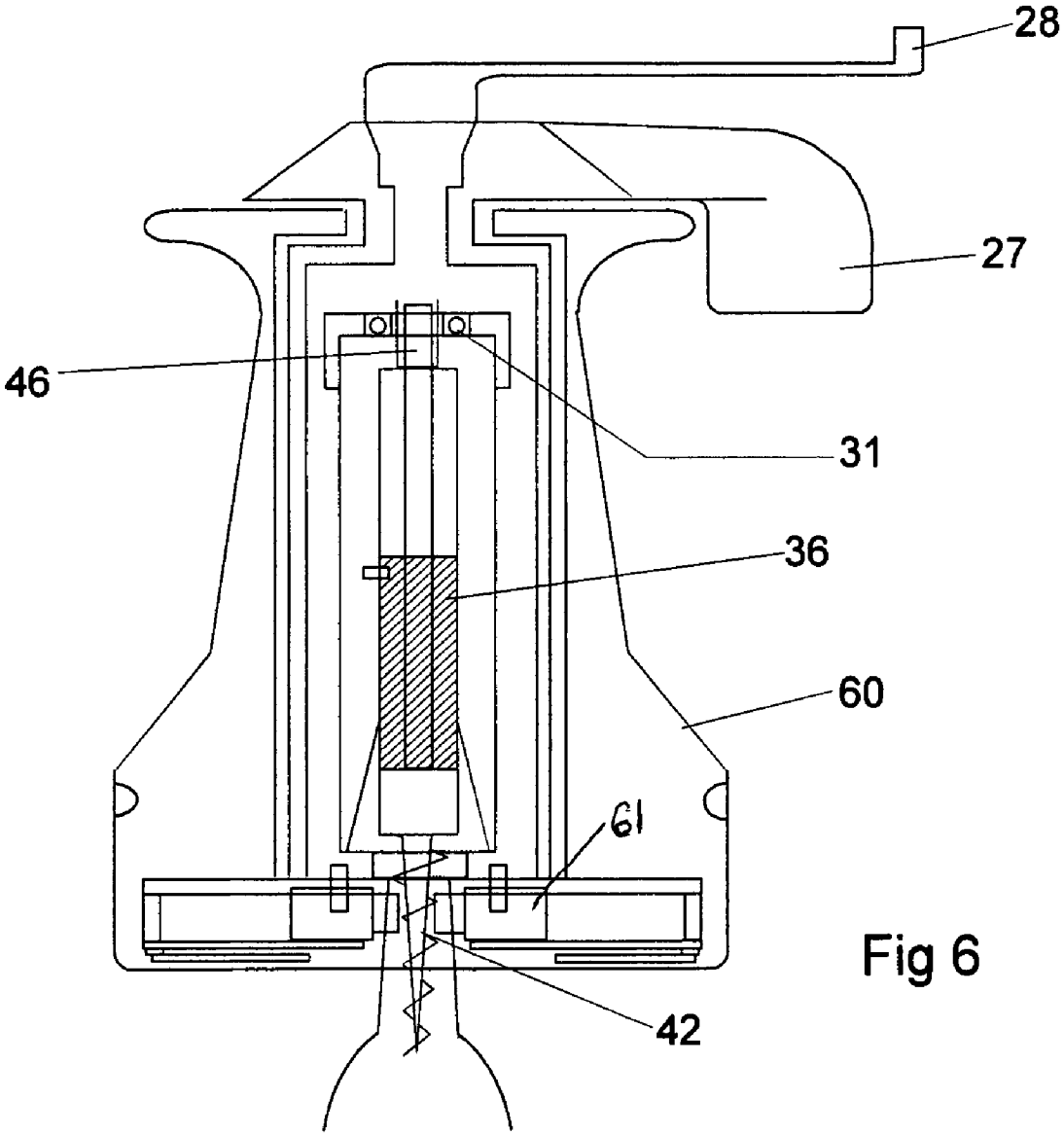
FIG. 6 is an alternative embodiment incorporating an alternative operating mechanism for a winch-type corkscrew assembly having a winch handle adapted for rotation about the axis of the auger type corkscrew tip.

An alternative embodiment is shown in FIG. 6, wherein the vertical assembly is housed in the winch body and the box 10 is eliminated. In this embodiment the winch assembly includes an extended body 60 for housing the plunger 36, the auger corkscrew 42, the drive pin 46 and the bearing assembly 31. The winch handle 27 is of a different configuration but operates in the same manner as the winch handle 28.

While certain embodiments and features of the invention have been described in detail herein, it should be understood that the invention includes all modifications and enhancements within the scope and spirit of the following claims.

What is claimed is:

1. A corkscrew device configured to resemble a nautical winch, comprising:

a. A housing for containing a corkscrew assembly, the housing having an opening in one wall for communicating with the cork in a bottle and an opening in another wall for communicating with the corkscrew assembly;

b. An auger tip carried in the housing and adapted to be rotated and extended into and withdrawn out of the said another wall of the housing and into and out of contact with the cork;

c. A drive mechanism mounted in the housing for rotating and extending the auger tip out of and withdrawing the auger tip into the housing, the auger tip mounted in a central bore in the housing, a drive pin in communication with and adapted to be rotated by the winch-type handle and mounted in the central bore, a plunger carried on the drive pin and in the central bore and adapted for both axial and rotational movement relative to the bore, and an auger type corkscrew mounted on the plunger for axial and rotational movement therewith; and d. A winch-type handle mounted outside the housing for rotation about a vertical axis in axial alignment with the auger tip and in driving communication with the drive mechanism, whereby rotation of the winch-type handle activates the drive mechanism for rotating and extending and withdrawing the auger tip.

2. The corkscrew assembly of claim 1, wherein the drive mechanism is mounted in a central bore extending the length of the housing, the drive mechanism further comprising:

a. A drive pin in communication with and adapted to be rotated by the winch-type handle;

b. A plunger carried on the drive pin and in the central bore and adapted for both axial and rotation movement relative to the bore; and c. An auger type corkscrew mounted on the plunger for axial and rotational movement therewith.

3. A corkscrew device configured to resemble a nautical winch, comprising:

a. A housing for containing a corkscrew assembly, the housing having an opening in one wall for communicating with the cork in a bottle and an opening in another wall for communicating with the corkscrew assembly;

b. An auger tip carried in the housing and adapted to be rotated and extended into and withdrawn out of the said another wall of the housing and into and out of contact with the cork;

c. A drive mechanism mounted in the housing for rotating and extending the auger tip out of and withdrawing the auger tip into the housing, the auger tip mounted in a central bore in the housing, a drive pin in communication with and adapted to be rotated by the winch-type handle and mounted in the central bore, a plunger carried on the drive pin and in the central bore and adapted for both axial and rotational movement relative to the bore, and an auger type corkscrew mounted on the plunger for axial and rotational movement therewith;

d. A winch-type handle mounted outside the housing for rotation about axis which is perpendicular to the axis of the auger tip and in driving communication with the drive mechanism, whereby rotation of the winch-type handle activates the drive mechanism for rotating and extending and withdrawing the auger tip; and e. a differential gear assembly mounted in the housing and in communication with both the drive mechanism and the winch-type handle for translating the horizontal rotation of the winch handle to vertical rotation in communication with the drive mechanism.

4. The corkscrew assembly of claim 3, wherein the drive mechanism is mounted in a central bore extending the length of the housing, the drive mechanism further comprising:

a. A drive pin in communication with and adapted to be rotated by the winch-type handle;

b. A plunger carried on the drive pin and in the central bore and adapted for both axial and rotation movement relative to the bore; and c. An auger type corkscrew mounted on the plunger for axial and rotational movement therewith.

* * * * *